US010279587B2

(12) United States Patent
Shimosato

(10) Patent No.: US 10,279,587 B2
(45) Date of Patent: May 7, 2019

(54) INKJET HEAD, INKJET PRINTER AND MANUFACTURING METHOD OF INKJET HEAD

(71) Applicant: TOSHIBA TEC KABUSHIKI KAISHA, Shinagawa-ku, Tokyo (JP)

(72) Inventor: Masashi Shimosato, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/498,796

(22) Filed: Apr. 27, 2017

(65) Prior Publication Data

US 2017/0334204 A1 Nov. 23, 2017

(30) Foreign Application Priority Data

May 23, 2016 (JP) ..... 2016-102564

(51) Int. Cl.
*B41J 2/14* (2006.01)
*B41J 2/16* (2006.01)

(52) U.S. Cl.
CPC ..... *B41J 2/14201* (2013.01); *B41J 2/14209* (2013.01); *B41J 2/1607* (2013.01); *B41J 2/1609* (2013.01); *B41J 2/1623* (2013.01); *B41J 2002/14491* (2013.01)

(58) Field of Classification Search
CPC ..... B41J 2/14201; B41J 2/14209; B41J 2002/14491
See application file for complete search history.

(56) References Cited

U.S. PATENT DOCUMENTS

2013/0002769 A1 1/2013 Koseki
2013/0050338 A1* 2/2013 Shimosato ..... B41J 2/14209 347/40

FOREIGN PATENT DOCUMENTS

JP 2000-168094 6/2000
JP 2015-085534 5/2015

* cited by examiner

*Primary Examiner* — Geoffrey S Mruk
(74) *Attorney, Agent, or Firm* — Amin, Turocy & Watson LLP

(57) ABSTRACT

An inkjet head comprises a drive section, a nozzle plate, a substrate and a wiring section. The drive section comprises two integral piezoelectric members of which polarization directions are opposite with respect to the longitudinal direction of the piezoelectric member, wherein a plurality of grooves arranged from one piezoelectric member to the middle of the other piezoelectric member and a plurality of holes arranged across the two piezoelectric members are alternately arranged along the longitudinal direction of the piezoelectric member. The nozzle plate is fixed on one main surface of the one piezoelectric member and comprises a plurality of nozzle holes facing the plurality of the grooves. The substrate is fixed with the other main surface of the other piezoelectric member. The wiring section is arranged on an inner surface of the hole and at a position facing the hole of the substrate.

19 Claims, 6 Drawing Sheets

(A)

(B)

INKJET HEAD, INKJET PRINTER AND MANUFACTURING METHOD OF INKJET HEAD

CROSS-REFERENCE TO RELATED APPLICATIONS

This application is based upon and claims the benefit of priority from Japanese Patent Application No. P2016-102564, filed May 23, 2016, the entire contents of which are incorporated herein by reference.

FIELD

Embodiments described herein relate generally to an inkjet head, an inkjet printer and a manufacturing method of the inkjet head.

BACKGROUND

A share mode/shared wall-type inkjet head is known as an inkjet head arranged in an inkjet printer.

The inkjet head includes a plurality of nozzle holes for ejecting ink and a plurality of pressure chambers with the nozzle holes. Further, there is an air chamber isolated from an ink flow path but no nozzle hole between pressure chambers.

DETAILED DESCRIPTION

In accordance with an embodiment, an inkjet head comprises a drive section, a nozzle plate, a substrate and a wiring section. The drive section comprises two integral piezoelectric members of which polarization directions are opposite with respect to the longitudinal direction of the piezoelectric member, wherein a plurality of grooves arranged from one piezoelectric member to the middle of the other piezoelectric member and a plurality of holes arranged across the two piezoelectric members are alternately arranged along the longitudinal direction of the piezoelectric member. The nozzle plate is fixed on one main surface of the one piezoelectric member and comprises a plurality of nozzle holes facing the plurality of the grooves. The substrate is fixed with the other main surface of the other piezoelectric member. The wiring section is arranged on an inner surface of the hole and at a position facing the hole of the substrate.

(First Embodiment)

Figure 1:
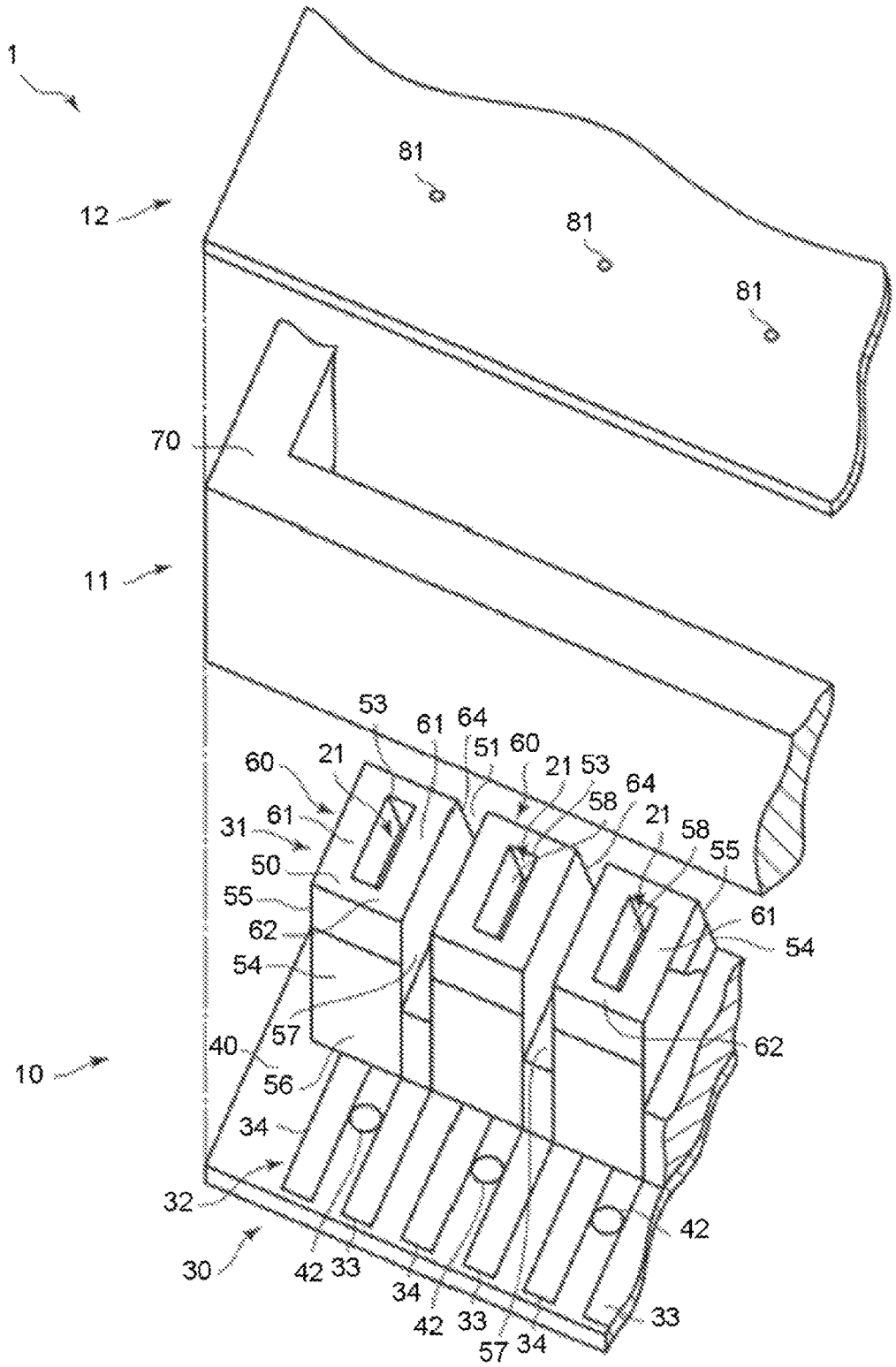
FIG. 1 is an exploded perspective view illustrating the constitution of an inkjet head according to a first embodiment.
Figure 2:
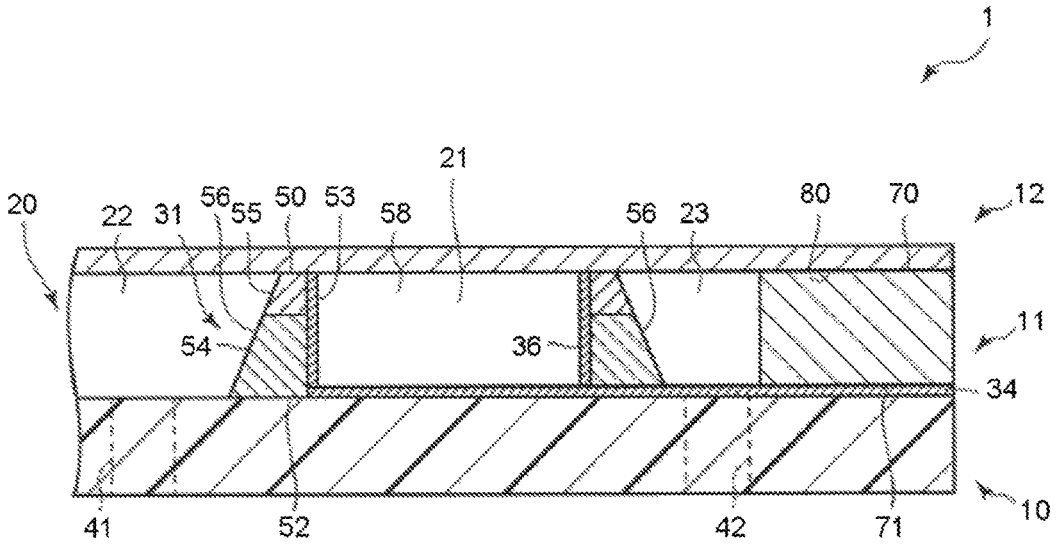
FIG. 2 is a cross-sectional view illustrating an air chamber of the inkjet head according to the first embodiment.
Figure 3:
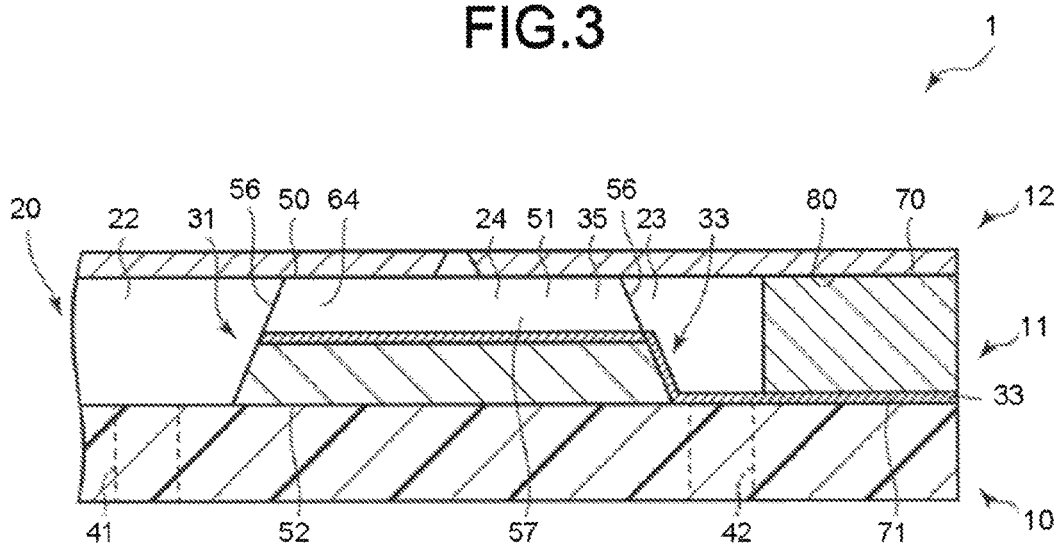
FIG. 3 is a cross-sectional view illustrating a pressure chamber of the inkjet head according to the first embodiment.
Figure 4:
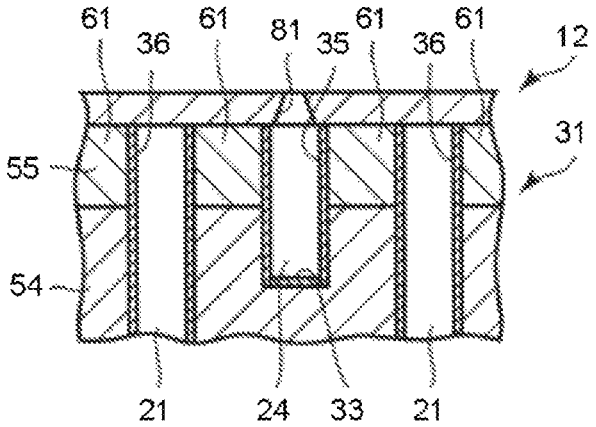
FIG. 4 is a cross-sectional view illustrating operations of the pressure chamber and the air chamber of the inkjet head according to the first embodiment.
Figure 4:
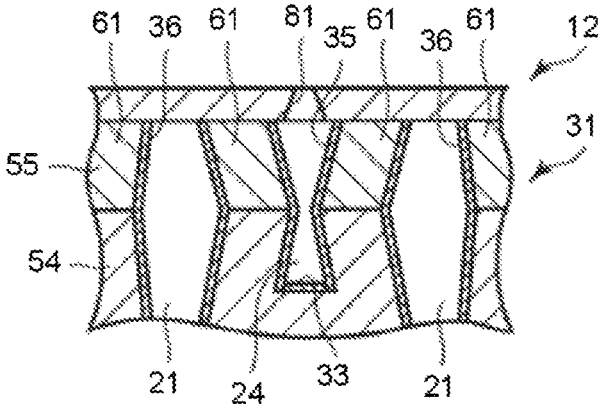
Figure 5:
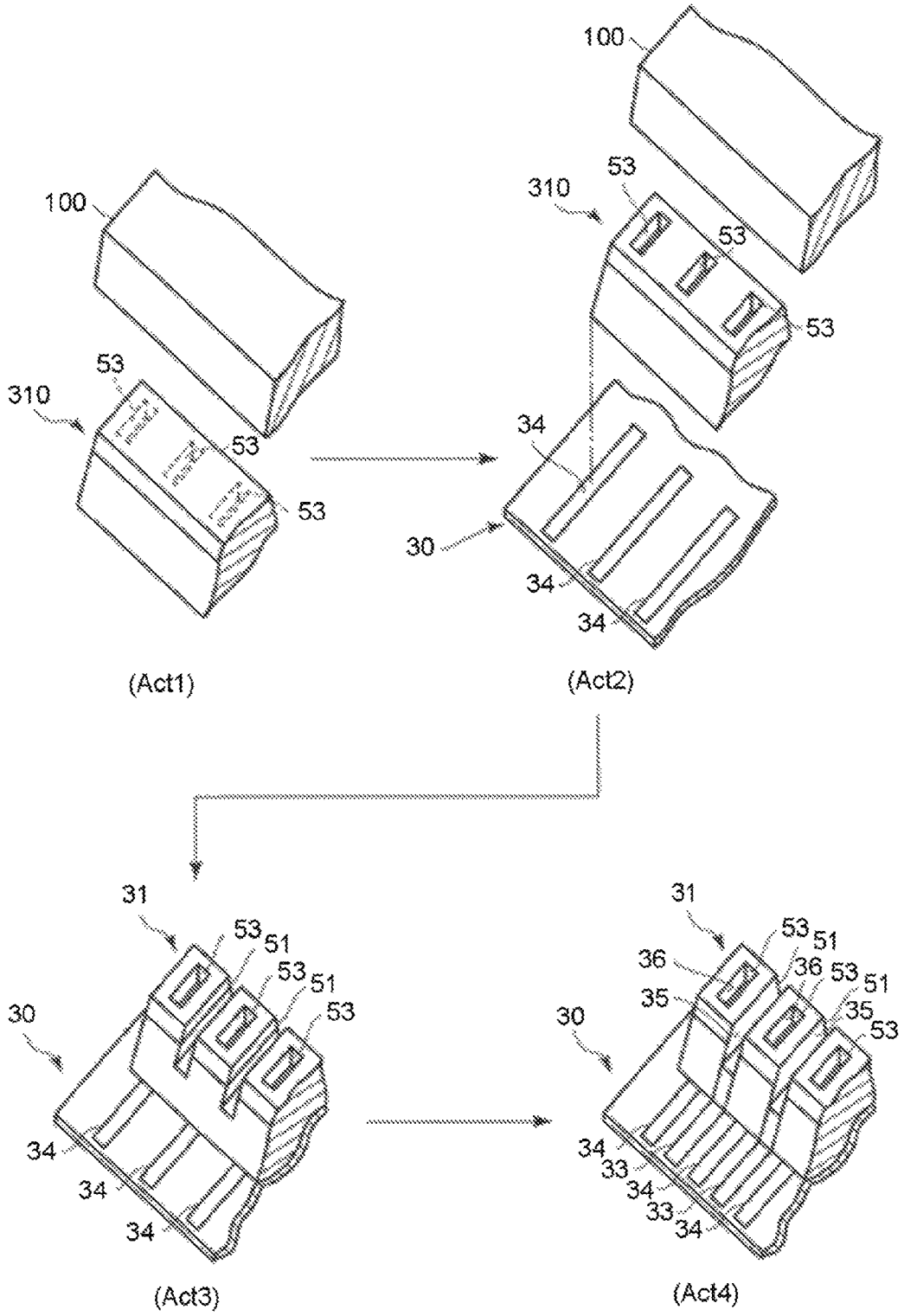
FIG. 5 is a view illustrating a manufacturing process of the inkjet head according to the first embodiment.

Hereinafter, the first embodiment is described with reference to FIG. 1 to FIG. 5. FIG. 1 is an exploded perspective view illustrating the constitution of an inkjet head 1 according to the first embodiment. FIG. 2 is a cross-sectional view illustrating an air chamber 21 of the inkjet head 1 according to the first embodiment. FIG. 3 is a cross-sectional view illustrating a pressure chamber 24 of the inkjet head 1 according to the first embodiment. FIG. 4 is a cross-sectional view illustrating drive of the pressure chamber 24 and the air chamber 21 of the inkjet head 1 according to the first embodiment. FIG. 5 is a view illustrating a manufacturing process of the inkjet head 1 according to the first embodiment.

The inkjet head 1 is arranged in an inkjet printer. For example, the inkjet printer prints characters and designs on a recording paper conveyed from a paper feed section by ejecting non-conductive ink sent from an ink tank to the inkjet head 1 from the inkjet head 1.

As shown in FIG. 1 to FIG. 3, the inkjet head 1 includes a head main body 10, a frame body 11 and a nozzle plate 12. The inkjet head 1 is integrally constituted by overlaying the head main body 10, the frame body 11 and the nozzle plate 12.

The inkjet head 1 includes a common liquid chamber 20 and a plurality of the air chambers 21 blocked from the common liquid chamber 20 in a space constituted by the head main body 10, the frame body 11 and the nozzle plate 12.

The head main body 10 includes a substrate 30, two drive sections 31 and a wiring section 32. The substrate 30 is a rectangular flat plate. The drive section 31, apart of the wiring section 32 and the frame body 11 are arranged on one main surface 40 of the substrate 30. The material of the substrate 30 is, for example, a non-conductive material. The substrate 30 is formed by, for example, alumina which is one kind of ceramic.

The substrate 30 includes a plurality of ink supply ports 41 and a plurality of ink discharge ports 42. The ink supply ports 41 and the ink discharge ports 42 are connected with the ink tank.

The ink supply port 41 is a hole section that penetrates through the substrate 30. The plurality of the ink supply ports 41 is arranged along the longitudinal direction of the substrate 30. One row of the plurality of the ink supply ports 41 arranged in this way is arranged at the central position in a direction orthogonal to the longitudinal direction of the substrate 30.

The ink discharge port 42 is a hole section that penetrates through the substrate 30. The plurality of the ink discharge ports 42 is arranged along the longitudinal direction of the substrate 30. Two rows of the plurality of the ink discharge ports 42 arranged in this way are arranged across the plurality of the ink supply ports 41 at both end sides orthogonal to the longitudinal direction of the substrate 30.

As shown in FIG. 1 to FIG. 3, the drive section 31 is, for example, a square column shape long in one direction, and the cross-sectional shape thereof in a direction orthogonal to the longitudinal direction is a trapezoidal. The two drive sections 31 are arranged in parallel in a direction orthogonal to the longitudinal direction of the substrate 30 in a direction along the longitudinal direction of the drive section 31. The drive section 31 includes a pair of inclined surfaces 56 formed in such a manner that side surfaces between main surfaces 50 and 52 are inclined with respect to the main surfaces 50 and 52. The main surface 52 of the drive section 31 is bonded to the substrate 30. The main surface 50 of the drive section 31 is bonded to the nozzle plate 12.

The drive section 31 includes a plurality of grooves 51 arranged on one main surface 50 and a plurality of holes 53 formed across a space between the one main surface 50 and the other main surface 52. The plurality of the grooves 51 and the plurality of the holes 53 are arranged alternately along the longitudinal direction of the drive section 31. In other words, the drive section 31 is constituted by the plurality of the grooves 51 and the plurality of the holes 53 at the one main surface 50 side, and includes a plurality of square cylinder-shaped wall sections 60 arranged along the longitudinal direction of the drive section 31.

The drive section 31 is constituted by bonding a first piezoelectric member 54 and a second piezoelectric member 55 in the rectangular parallelepiped shape with polarization directions opposite along the longitudinal direction of the drive section 31, and processing the groove 51, the hole 53 and the inclined surface 56 on the first piezoelectric member 54 and the second piezoelectric member 55 bonded.

The first piezoelectric member 54 constitutes the substrate 30 side of the drive section 31, and the second piezoelectric member 55 constitutes the nozzle plate 12 side of the drive section 31. The first piezoelectric member 54 is made thicker than the second piezoelectric member 55. The materials of the first piezoelectric member 54 and the second piezoelectric member 55 are for example, PZT (Lead Titanate Zirconate).

The groove 51 is formed in a long linear shape in a direction orthogonal to the longitudinal direction of the drive section 31. The groove 51 is arranged across the two inclined surfaces 56 of the drive section 31. The groove 51 is formed with a depth from the second piezoelectric member 55 to a part of the first piezoelectric member 54 from the one main surface 50 to the other main surface 52. The groove 51 constitutes a space between opposite outer surfaces 64 of two adjacent wall sections 60.

The hole 53 is a square column-shaped opening which is formed extending from the one main surface 50 at the second piezoelectric member 55 side of the drive section 31 to the other main surface 52 at the first piezoelectric member 54 side. The hole 53 is located at the center part of the wall section 60. The hole 53 constitutes a space across an area between the two main surfaces 50 and 52 of the drive section 31.

The wall section 60 includes a pair of first wall sections 61 and a pair of second wall sections 62. The first wall section 61 is formed in a long linear shape in a direction orthogonal to the longitudinal direction of the drive section 31. The pair of the first wall sections 61 faces each other via the hole 53. The first wall section 61 is formed orthogonal to the surface direction of the nozzle plate 12.

The first wall section 61 is constituted by the first piezoelectric member 54 and the second piezoelectric member 55. The first wall section 61 is constituted variably at the groove 51 side by being applied with a voltage.

The second wall section 62 is formed in a long linear shape along the longitudinal direction of the drive section 31. The pair of the second wall sections 62 faces each other via the hole 53. The pair of the second wall sections 62 is continuous with both end parts of the pair of the first wall sections 61. The pair of the second wall sections 62 constitutes the square cylinder-shaped wall section 60 together with the pair of the first wall sections 61.

The wiring section 32 includes a plurality of first wiring sections 33, a plurality of second wiring sections 34, a plurality of first electrodes 35, and a plurality of second electrodes 36. The wiring section 32 is formed on the substrate 30 and the drive section 31 by, for example, a conductive metal thin film.

The first wiring section 33 is electrically connected with the first electrode 35 and a signal generation section of the inkjet printer. The first wiring section 33 is arranged continuously in a band shape on the upper surface of the drive section 31 constituting the groove 51, the inclined surface 56 of the drive section 31 and the main surface 40 of the substrate 30 at a second liquid chamber 23 side. The first wiring section 33 is arranged on the main surface 40 of the substrate 30 avoiding the ink discharge port 42. The inner surface of the drive section 31 is a part of an inner surface 57 of the groove 51.

The second wiring section 34 is electrically connected with the second electrode 36 and a ground. The hole 53 is arranged on one end part of the second wiring section 34. In other words, the second wiring section 34 is formed on the substrate 30 from a position facing the hole 53 of the drive section 31 to the outer edge of the substrate 30 along the longitudinal direction of the drive section 31. The second wiring section 34 is arranged on the main surface 40 of the substrate 30 avoiding the ink discharge port 42.

The plurality of the first wiring sections 33 and the plurality of the second wiring sections 34 are arranged respectively corresponding to the plurality of the grooves 51 and the plurality of the holes 53 of each drive section 31. The plurality of the first wiring sections 33 and the plurality of the second wiring sections 34 are arranged alternately along the longitudinal direction of each drive section 31.

The first electrodes 35 are respectively arranged on the outer surfaces 64 of the opposite first wall sections 61 of the adjacent wall sections 60. The first electrode 35 is electrically connected with the first wiring section 33 arranged on the upper surface of the drive section 31. The first electrode 35 is formed in such a way as to be capable of applying a voltage to the first wall section 61 connected with the signal generation section via the first wiring section 33. The plurality of the first electrodes 35 formed in the plurality of the grooves 51 constitutes an individual electrode.

The second electrode 36 is arranged on an inner surface 58 of the drive section 31 constituting the hole 53. The second electrode 36 is electrically connected with an end part of the second wiring section 34. The second electrode 36 is formed in a groundable manner via the second wiring section 34. The plurality of the second electrodes 36 formed in the plurality of the holes 53 constitutes a common electrode.

The frame body 11 is formed in a square cylindrical shape along the shape of the outer edge of the substrate 30. The frame body 11 surrounds the pair of the drive sections 31, the plurality of the ink supply ports 41 and the plurality of the ink discharge ports 42. The height between two main surfaces 70 and 71 of the frame body 11 is the same as that between two main surfaces 50 and 52 of the drive section 31 arranged on the substrate 30. The main surfaces 70 and 71 of the frame body 11 are bonded with the nozzle plate 12 and the substrate 30.

The nozzle plate 12 is formed into a rectangular flat plate shape. A main surface 80 of the nozzle plate 12 has substantially the same shape as the main surface 40 of the substrate 30. The main surface 80 of the nozzle plate 12 is bonded to the one main surface 70 of the frame body 11 and the one main surface 50 of the drive section 31. The nozzle plate 12 covers an opening of the frame body 11.

The nozzle plate 12 includes a plurality of nozzle holes 81. The plurality of the nozzle holes 81 is arranged along the longitudinal direction of the nozzle plate 12. For example, two rows of the plurality of the nozzle holes 81 are arranged in the longitudinal direction of the nozzle plate 12. The nozzle holes 81 are respectively formed at locations corresponding to the plurality of the grooves 51.

The common liquid chamber 20 includes a first liquid chamber 22, two second liquid chambers 23 and a plurality of pressure chambers 24.

The first liquid chamber 22 constitutes a space formed by a part of the main surface 40 of the substrate 30 located between the pair of the drive sections 31, the inclined surfaces 56 of the pair of the drive sections 31 at the ink supply port 41 side, and a part of the main surface 80 of the nozzle plate 12. The first liquid chamber 22 is connected with the ink tank via the ink supply port 41. The first liquid chamber 22 forms an ink flow path from the ink supply port 41 to the plurality of the pressure chambers 24.

The second liquid chamber 23 constitutes a space formed by the inclined surface 56 of the drive section 31 at the ink discharge port 42 side, a part of the frame body 11, a part of the main surface 40 of the substrate 30 arranged with the ink discharge port 42 surrounded by a part of the frame body 11 and the inclined surface 56, and a part of the nozzle plate 12. The second liquid chamber 23 is connected with the ink tank via the ink discharge port 42. The second liquid chamber 23 forms an ink flow path for discharging ink sent from the first liquid chamber 22 via the pressure chamber 24 from the ink discharge port 42 to the ink tank.

The pressure chamber 24 forms an ink flow path for communicating with the first liquid chamber 22 and the second liquid chamber 23. The pressure chambers 24 of which the number is the same as the plurality of the grooves 51 is constituted along the longitudinal direction of the drive section 31.

The pressure chamber 24 is formed by apart of the drive section 31 constituting the periphery of the groove 51, and a part of the nozzle plate 12 blocking the groove 51. The part of the drive section 31 constituting the periphery of the groove 51 includes the opposing first wall sections 61 of the adjacent wall sections 60. The pressure chamber 24 is formed to eject ink flowing into the pressure chamber 24 from the nozzle hole 81 due to deformation of the first wall section 61 to which a voltage is applied.

An air chamber 21 is shielded from the common liquid chamber 20 to be constituted. The air chamber 21 is formed alternately with the pressure chamber 24 along the longitudinal direction of the drive section 31. The air chamber 21 is formed by a part of the drive section 31 constituting the periphery of the hole 53, a part of the nozzle plate 12 blocking the opening of the hole 53 of the drive section 31 at the main surface 50 side, and a part of the substrate 30 blocking the opening of the hole 53 of the drive section 31 at the main surface 52 side. The part of the drive section 31 constituting the periphery of the hole 53 includes the wall section 60.

Next, ejection operations of ink in the inkjet head 1 are described. The ink from the ink tank is supplied to the common liquid chamber 20 of the inkjet head 1 via the ink supply port 41. Specifically, the ink supplied from the ink supply port 41 to the first liquid chamber 22 passes through the plurality of the pressure chambers 24, and is discharged from the ink discharge port 42 to the ink tank via the second liquid chamber 23.

As shown in FIG. 4 (A), in a state in which no voltage is applied to the first wall section 61, the first wall section 61 is located at a reference position orthogonal to the nozzle plate 12.

Next, if the voltage is applied to the pair of the first wall sections 61 constituting the pressure chamber 24, as shown in FIG. 4 (B), the pair of the first wall sections 61 is deformed in a direction in which the volume of the pressure chamber 24 is reduced. In other words, the pair of the first wall sections 61 is respectively bent in a direction in which the first wall sections 61 approach to each other.

If the first wall sections 61 are respectively bent in directions close to each other, as the volume of the pressure chamber 24 is reduced, the ink inside the pressure chamber 24 is pressurized, and the ink is ejected from the nozzle hole 81. After that, if the application of the voltage to the first wall section 61 is stopped, the first wall section 61 returns to the reference position shown in FIG. 4 (A). Such the ejection operation is carried out in the pressure chamber 24 corresponding to the nozzle hole 81 that ejects the ink to the recording paper.

Next, a manufacturing method of the inkjet head 1 is described with reference to FIG. 1 and FIG. 5. Firstly, the first piezoelectric member 54 and the second piezoelectric member 55 are bonded with polarization directions opposite in the longitudinal direction of the drive section 31 to form a rectangular parallelepiped piezoelectric member 310 serving as the material of the drive section 31.

Next, the outline of the piezoelectric member 310 formed by sticking the first piezoelectric member 54 and the second piezoelectric member 55 together is processed through a milling machine and cutting. For example, the piezoelectric member 310 is a square column shape long in one direction as shown in FIG. 1, and processed so that the cross-sectional shape in a direction orthogonal to the longitudinal direction is a trapezoidal.

Next, the hole 53 extending from the one main surface 50 to the other main surface of the piezoelectric member 310 is formed using an ultrasonic processing device 100 (Act 1). The plurality of the holes 53 is formed along the longitudinal direction of the piezoelectric member 310. The size of the hole 53 is, for example, a few tens of μm.

Next, the main surface 40 of the substrate 30 on which the second wiring section 34 is arranged in advance and the other main surface 52 of the piezoelectric member 310 are bonded (Act 2). The piezoelectric member 310 is bonded at a position at which one end of each of the plurality of the second wiring sections 34 arranged on the main surface 40 of the substrate 30 faces each of the plurality of the holes 53.

After bonded with the substrate 30, the piezoelectric member 310 further forms the plurality of the grooves 51 in a direction orthogonal to the longitudinal direction of the piezoelectric member 310 between the two adjacent holes 53 using the ultrasonic processing device 100 (Act 3). The grooves 51 and the holes 53 are formed alternately, and in this way, the first wall section 61 is formed between the groove 51 and the hole 53. The drive section 31 is formed by processing the piezoelectric member 310 in this way.

Next, the wiring section 32 other than the second wiring section 34 arranged on the substrate 30 is formed (Act 4). Specifically, a conductive metal thin film is formed on the inner surface 58 constituting the hole 53, the outer surface of the first wall section 61 constituting the groove 51, the upper surface constituting the groove 51 and the main surface 40 of the substrate 30. The metal thin film is formed by, for example, an electroless plating method. The drive section 31 and the substrate 30 on which the metal thin film is formed then remove unnecessary parts of the metal thin film through a laser process. Through these processes, the plurality of the first wiring sections 33, the plurality of the second wiring sections 34, the plurality of the first electrodes 35 and the plurality of the second electrodes 36 are formed on the substrate 30 and the drive section 31. In this way, the head main body 10 can be obtained.

The inkjet head 1 constituted in this way arranges the hole 53 across the two main surfaces 50 and 52 of the drive section 31 and can easily form the air chamber 21 isolated from the common liquid chamber 20 by blocking the hole 53 with the nozzle plate 12 and the substrate 30.

Specifically, in the air chamber 21, the hole 53 formed across the two main surfaces 50 and 52 of the drive section 31 using the ultrasonic processing device 100 is blocked with a part of the nozzle plate 12 and a part of the substrate 30. Thus, the air chamber 21 does not require a complex process such as closing both ends of the groove 51 with other sealing materials.

Further, in the inkjet head 1, the hole 53 is formed extending from the one main surface 50 of the drive section 31 to the other main surface 52. Thus, the wiring section 32 can easily manufacture the second electrode 36 connected with the second wiring section 34 by forming an electrode film on the inner surface 58 of the hole 53 after carrying out alignment of the end part of the second wiring section 34 formed on the substrate 30 in advance and the hole 53.

(Second Embodiment)

Figure 6:
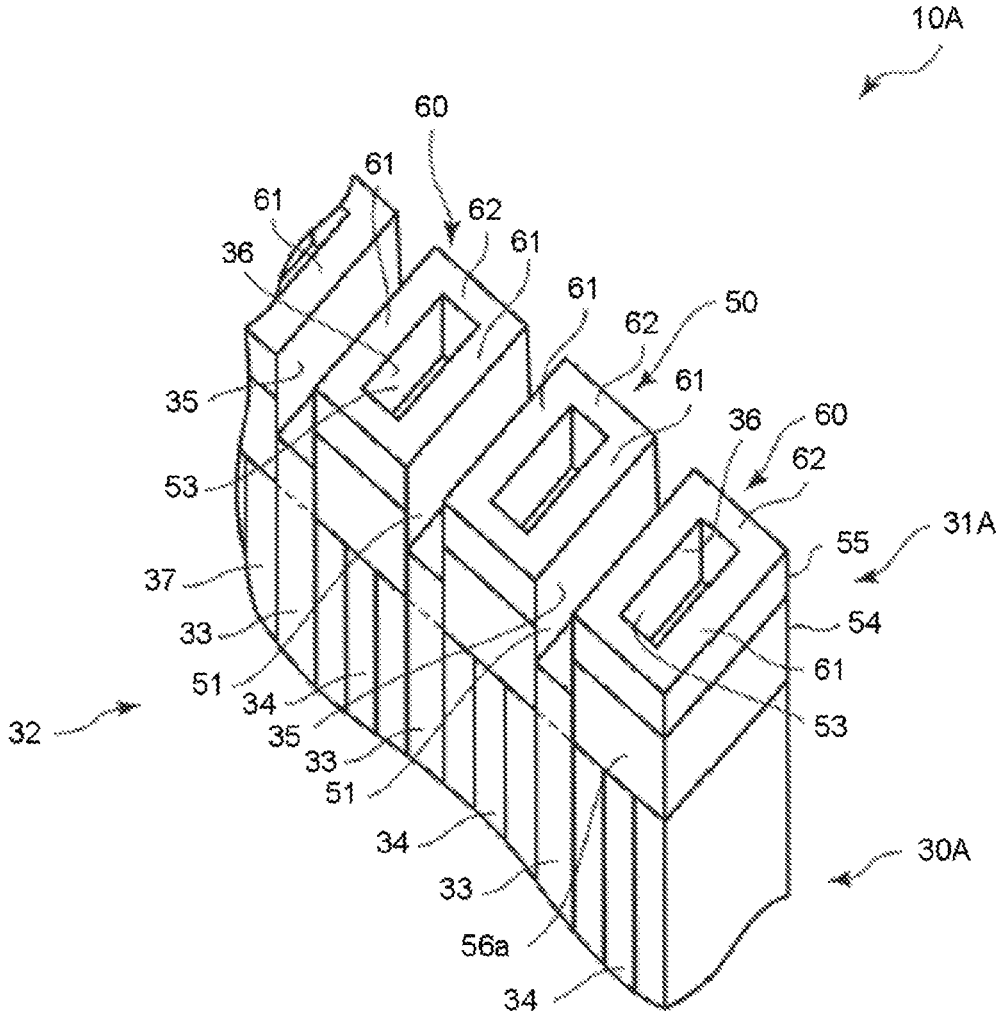
FIG. 6 is a perspective view illustrating main portions of an inkjet head according to a second embodiment.

Next, the constituting of a head main body 10A according to the second embodiment is described with reference to FIG. 6. FIG. 6 is a perspective view illustrating the constitution of the head main body 10A according to the second embodiment. Furthermore, in the constitution of the head main body 10A according to the second embodiment, the same elements as the foregoing head main body 10 of the inkjet head 1 according to the first embodiment are applied with the same reference numerals, and the detailed descriptions thereof are emitted.

As shown in FIG. 6, the head main body 10A includes a substrate 30A, two drive sections 31A and a wiring section 32. The substrate 30A is formed in a square column shape. The drive section 31A is arranged on an end part of the substrate 30A, and a part of the wiring section 32 is formed on an end part of the substrate 30A and a side wall 37.

As shown in FIG. 6, the drive section 31A is, for example, a square column shape long in one direction, and the cross-sectional shape in a direction orthogonal to the longitudinal direction is formed into a rectangle. The drive section 31A includes a plurality of grooves 51 arranged on one main surface 50 and a plurality of holes 53 formed across a space between the one main surface 50 and the other main surface 52. The plurality of the grooves 51 and the plurality of the holes 53 are arranged alternately along the longitudinal direction of the drive section 31. In other words, the drive section 31A is arranged along the longitudinal direction, and includes a plurality of square cylinder-shaped wall sections 60 constituted by the plurality of the grooves 51 and the plurality of the holes 53 at the one main surface 50 side.

The main surface 52 of the drive section 31A is bonded to the substrate 30A. The drive section 31A includes the first piezoelectric member 54 and the second piezoelectric member 55 in the rectangular parallelepiped shape. The drive section 31A includes a vertical surface 56A vertical to the main surface 50.

The wiring section 32 includes the plurality of the first wiring sections 33, the plurality of the second wiring sections 34, the plurality of the first electrodes 35, and the plurality of the second electrodes 36. The first wiring section 33 is formed connectable with the signal generation section of the inkjet printer. Further, the second wiring section 34 is drawn to the outside of the inkjet head along the side wall 37 of the substrate 30A to be grounded.

The drive section 31A including the plurality of the grooves 51 and the plurality of the holes 53 forms the pressure chamber 24 and the air chamber 21 together with the nozzle plate and the substrate 30A.

The head main body 10A constituted in this way is the constitution in which the cross-sectional shape in a direction orthogonal to the longitudinal direction of the drive section 31A is formed into a rectangle and the wiring section 32 is extended and connected along the side wall 37 of the substrate 30A. Thus, the head main body 10A can shorten the length in the direction orthogonal to the longitudinal direction of the drive section 31A. In other words, it is possible that the inkjet head incorporated with the head main body 10A shortens the width in a direction orthogonal to the row of the nozzle holes 81. Thus, the inkjet head incorporated with the head main body 10A can be miniaturized.

According to the inkjet heads 1 and 1A of at least one embodiment described above, the air chamber 21 can be easily formed by including the hole 53 across the space between the two main surfaces 50 and 52 in the drive sections 31 and 31A.

Figure 7:
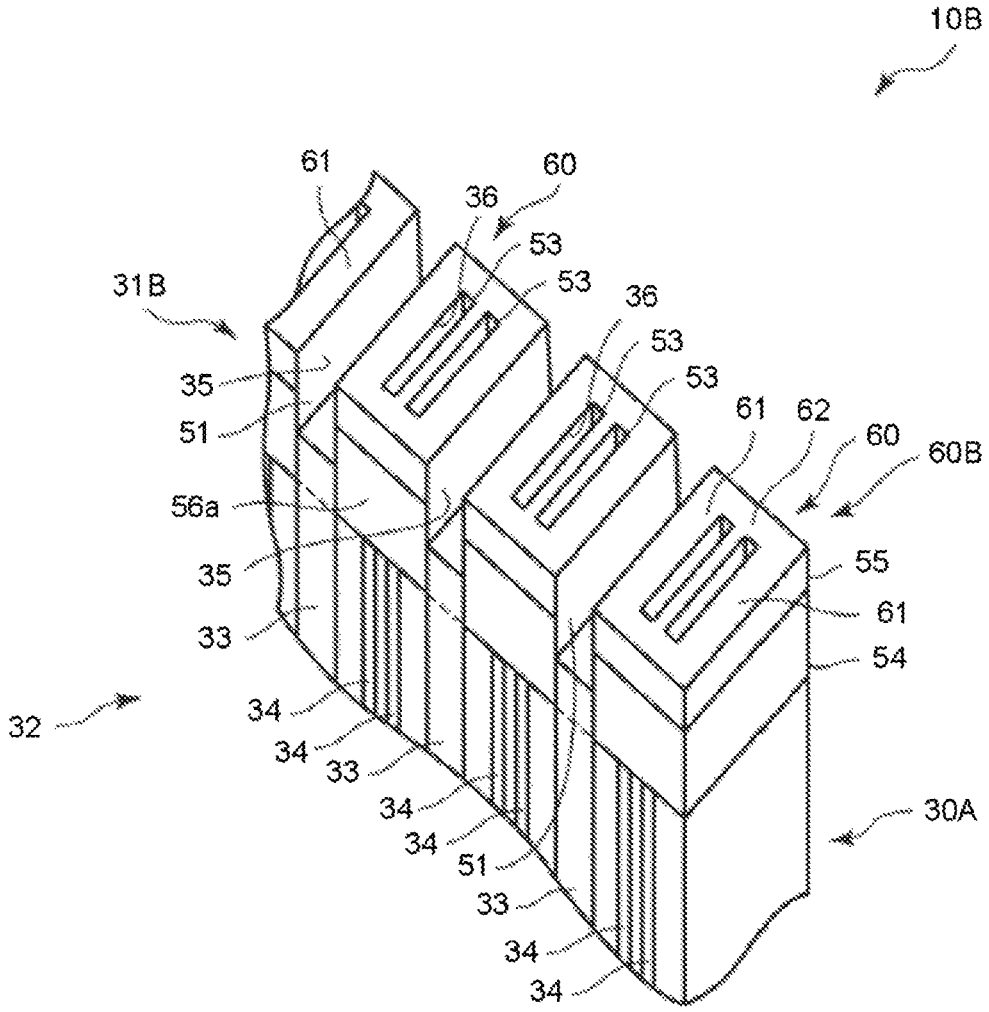
FIG. 7 is a perspective view illustrating main portions of an inkjet head according to a third embodiment.

The inkjet heads 1 and 1A according to the present embodiment are not limited to the foregoing constitution. For example, as shown in a head main body 10B according to a third embodiment shown in FIG. 7, the head main body 10B may include a drive section 31B on the substrate 30A which alternately has a groove 51 and two holes 53. In the drive section 31B with such the constitution, the two holes 53 are arranged between the two grooves 51, and thus the two holes 53 are independent, and the two air chambers 21 independent separately are arranged between two pressure chambers 24. Thus, even if the volume of the one air chamber 21 is varied, it can be prevented that the volume of the other air chamber 21 is varied. Further, by using the head main body 10B with such the constitution in the inkjet head, it is possible to wire an electrode connected with the signal generation section in such a manner that the electrode is not contacted with ink. Thus, the inkjet head with the head main body 10B can use conductive ink without forming an insulating film.

Further, in the examples described above, the constitution in which the drive sections 31 and 31A apply the voltage to the first electrode 35 of the pressure chamber 24 is described; however, the present invention is not limited to this. For example, the constitution may be such that the voltage is applied alternately to both of the first electrode 35 and the second electrode 36.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head, comprising:

a drive section comprising two integral piezoelectric members of which polarization directions are opposite with respect to a longitudinal direction of the two integral piezoelectric members, a plurality of grooves being arranged from a first piezoelectric member of the two integral piezoelectric members to a middle of a second piezoelectric member of the two integral piezoelectric members and a plurality of holes being arranged across the two integral piezoelectric members are alternately arranged along the longitudinal direction of the two integral piezoelectric members;

a nozzle plate fixed on a main surface of the first piezoelectric member and comprising a plurality of nozzle holes facing the plurality of grooves;

a substrate having a plurality of holes therein fixed with a main surface of the second piezoelectric member; and a wiring section arranged on an inner surface of the plurality of nozzle holes and at a position facing the respective holes of the substrate.

2. The inkjet head according to claim 1, wherein the wiring section comprises a first wiring section arranged on a first electrode arranged on an inner surface of the grooves, an outer surface of the drive section, and the substrate, and a second wiring section arranged on the inner surface of the plurality of nozzle holes and at a position facing the substrate.

3. The inkjet head according to claim 1, wherein the drive section comprises a vertical surface perpendicular to the main surface of the first piezoelectric member.

4. The inkjet head according to claim 1, wherein each hole is arranged between two grooves.

5. The inkjet head according to claim 1, wherein the inkjet head is configured to print with non-conducive ink.

6. The inkjet head according to claim 1, further comprising:

an air chamber formed along a longitudinal direction of the drive section.

7. The inkjet head according to claim 1, further comprising:

a pressure chamber formed by a part of the drive section constituting a periphery of a groove, and a part of the nozzle plate blocking the groove.

8. The inkjet head according to claim 1, further comprising:

a common liquid chamber.

9. The inkjet head according to claim 8, wherein the common liquid chamber comprises a first liquid chamber, two second liquid chambers, and a plurality of pressure chambers.

10. An inkjet printer, comprising:

a paper feed section;

an ink tank; and an inkjet head comprising a drive section comprising two integral piezoelectric members of which polarization directions are opposite with respect to a longitudinal direction of the two integral piezoelectric members, a plurality of grooves being arranged from a first piezoelectric member of the two integral piezoelectric members to the middle of a second piezoelectric member of the two integral piezoelectric members and a plurality of holes being arranged across the two integral piezoelectric members are alternately arranged along the longitudinal direction of the two integral piezoelectric members;

a nozzle plate fixed on a main surface of a first piezoelectric member and comprising a plurality of nozzle holes facing the plurality of grooves;

a substrate having a plurality of holes therein fixed with a main surface of a second piezoelectric member; and a wiring section arranged on an inner surface of the plurality of nozzle holes and at a position facing the respective holes of the substrate.

11. The inkjet printer according to claim 10, wherein the wiring section comprises a first wiring section arranged on a first electrode arranged on an inner surface of the grooves, an outer surface of the drive section, and the substrate, and a second wiring section arranged on the inner surface of the plurality of nozzle holes and at a position facing the substrate.

12. The inkjet printer according to claim 10, wherein the drive section comprises a vertical surface perpendicular to the main surface of the first piezoelectric member.

13. The inkjet printer according to claim 10, wherein each hole is arranged between two grooves.

14. The inkjet printer according to claim 10, wherein the inkjet head is configured to print with non-conducive ink.

15. The inkjet printer according to claim 10, further comprising:

an air chamber formed along a longitudinal direction of the drive section.

16. The inkjet printer according to claim 10, further comprising:

a pressure chamber formed by a part of the drive section constituting a periphery of a groove, and a part of the nozzle plate blocking the groove.

17. The inkjet printer according to claim 10, further comprising:

a common liquid chamber.

18. The inkjet printer according to claim 17, wherein the common liquid chamber comprises a first liquid chamber, two second liquid chambers, and a plurality of pressure chambers.

19. The inkjet printer according to claim 10, wherein the ink tank is a non-conductive ink tank.

* * * * *